US006014068A

United States Patent [19]

Nobutoki et al.

[11] Patent Number: 6,014,068

[45] Date of Patent: Jan. 11, 2000

[54] ELECTROMAGNETIC RELAY

[75] Inventors: Kazuhiro Nobutoki, Matsusaka; Hiroyuki Kita; Kazuaki Nishimura, both of Mie, all of Japan

[73] Assignee: Matsushita Electric Works, Ltd., Kadoma, Japan

[21] Appl. No.: 09/225,567

[22] Filed: Jan. 5, 1999

[30] Foreign Application Priority Data

Jan. 27, 1998 [JP] Japan ..... 10-014571

[51] Int. Cl.[7] ..... H01H 51/22

[52] U.S. Cl. ..... 335/78; 336/196; 336/206; 336/208

[58] Field of Search ..... 335/78–86, 128; 336/198, 206, 208, 96

[56] References Cited

U.S. PATENT DOCUMENTS

| | | | |
|---|---|---|---|
| 2,180,420 | 11/1939 | Larsen | 336/208 |
| 3,043,994 | 7/1962 | Anderson et al. | 336/96 |
| 5,374,308 | 12/1994 | Dittman et al. | 335/78 |

OTHER PUBLICATIONS

A. B. Brown, "Fabrication of Ultrathin Bobbins", IBM Technical Disclosure Bulletin, Jun. 1970.

*Primary Examiner*—Renee S. Luebke
*Assistant Examiner*—Tuyer T. Nguyen
*Attorney, Agent, or Firm*—Nikaido, Marmelstein, Murray & Oram, LLP

[57] ABSTRACT

A miniature electromagnetic relay is capable of increasing the coil packing density, yet assuring electrical insulation of the coil from a core of the electromagnet. The relay includes a pair of movable and fixed contacts, an armature carrying the movable contact, and an electromagnet block having an excitation coil which moves the armature for closing and opening the contacts upon being energized. The electromagnet block includes a generally U-shaped core with a center core and a pair of yokes extending from opposite ends of the center core, flanges of dielectric material molded respectively around portions of the yokes, and a dielectric tape fitted around the center core over substantially the entire length of the center core to receive therearound the excitation coil in an electrically insulating relation from the core. Each of the flanges is formed integrally with an inward sleeve which extends over a limited length along the center core in such a relation that the dielectric tape overlaps the inward sleeves at opposite width ends of the tape. Thus, the coil can be wound over the substantially full length of the core and be successfully insulated from the core over the full length thereof without requiring additional separate member.

8 Claims, 4 Drawing Sheets

70
17
15
51
15
15
50
10
17
11
15
12
13
12
33
33
65
62
67
65
60
68
61
65

ELECTROMAGNETIC RELAY

BACKGROUND OF THE INVENTION

1. Field of the Invention

The present invention is directed to an electromagnetic relay, and more particularly to a miniature relay having a compact electromagnet block with a high coil packing density.

2. Description of the Prior Art

A known electromagnetic relay utilizes an electromagnet block composed of a core, a pair of flanges of dielectric materials molded on opposite ends of the core, and an excitation coil wound around the core between the flanges. In order to make electrical insulation between the core and the coil while disposing the coil as many turns as possible between the flanges for increasing coil packing density, it has been a common practice to use a thin dielectric tape for wrapping around the core between the flanges. For this purpose, the tape is desired to have a width not less than a distance between the flanges so as to fully cover the entire length of the core. However, such tape is rather difficult to be put around the core without causing interference with the flanges, thereby lowering assembly efficiency. For avoiding this inconvenience, it has been proposed to use a tape of smaller width in combination with collars which is fitted on the core to cover gaps between the width ends of the tape and the adjacent flanges. The collar is in the form of plate with a slit in which the core is fit and is held in abutment with the flange, thereby defining an effective coil space between the collars. The coil is then wound on the tape over a reduced distance between the collars. Although this scheme is effective for insulation between the coil and the core, the presence of the collars reduce the coil space to thereby lower the coil packing density, in addition to increasing the number of the components with corresponding increase in the manufacturing cost.

SUMMARY OF THE INVENTION

The present invention has been accomplished in view of the above problems to provide an improved miniature electromagnetic relay which is capable of increasing the coil packing density, yet assuring electrical insulation of the coil from a core of the electromagnet. The electromagnetic relay of the present invention includes a pair of movable and fixed contacts, an armature carrying the movable contact, and an electromagnet block having an excitation coil which moves the armature for closing and opening the contacts upon being energized. The electromagnet block includes a core composed of a center core and a pair of yokes extending from opposite ends of the center core, flanges of dielectric material molded respectively around portions of the yokes, and a dielectric tape fitted around the center core over substantially the entire length of said center core to receive therearound the excitation coil in an electrically insulating relation from the core. Each of the flanges is formed integrally with an inward sleeve which extends over a limited length along the center core in such a relation that the dielectric tape overlaps the inward sleeves at opposite width ends of the tape. Thus, the coil can be wound over the substantially full length of the core and be successfully insulated from the core over the full length thereof without requiring additional separate member.

Preferably, the center core is formed at its opposite ends respectively with recess into which the inward sleeves fit to give a continuous outer surface from the inward sleeves to the center core. This structure enables the coil to increase the number of turns around the core for further increasing the coil packing density around the core between the flanges.

The excitation coil may be encapsulated together with the core and the flanges into the single electromagnet block by an encapsulating molding material which has a melting point higher that of the flanges. Because of the use of the molding materials of different melting points, when encapsulating the coil, the core, and the flanges into the electromagnet block, the outer surface of the flanges can be melted to thereby fill gaps between the flanges and the resulting electromagnet block, increasing electrical insulation of the coil from external components carrying electricity. The encapsulation molding material may be liquid crystal polyester when the molding material of the flange is one of polybutylene-telephtaleta (PBT) and polycyclohexylenedimethylene terephthalate (PCT). Further, the encapsulation molding material and the molding material of the flange are both selected from the liquid crystal polyesters of different melting points.

These and still other objects and advantageous features of the present invention will become more apparent from the following description of the embodiments when taken in conjunction with the attached drawings.

DETAILED DESCRIPTION OF THE EMBODIMENT

Figure 1:
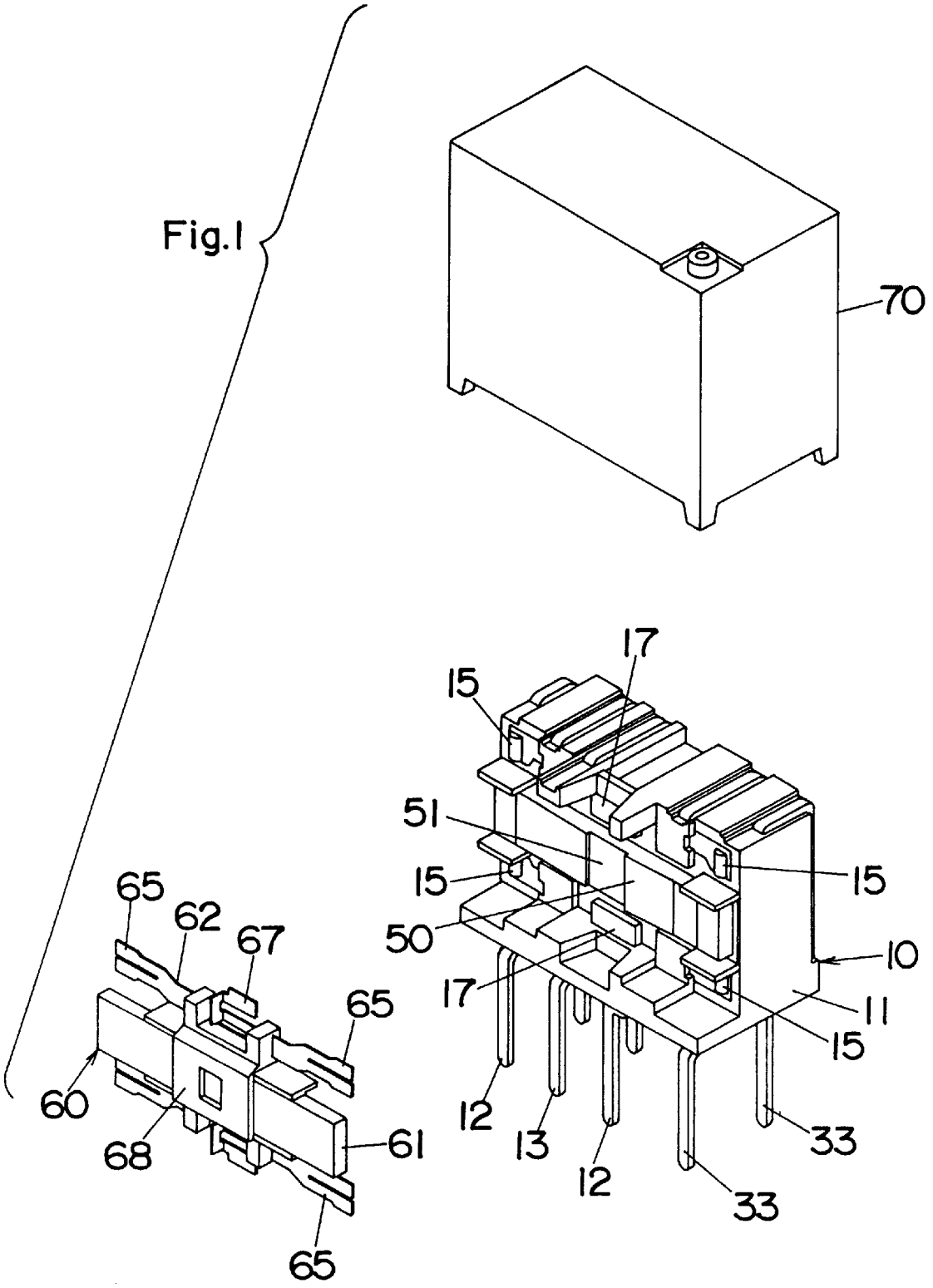
FIG. 1 is an exploded perspective view of an electromagnetic relay in accordance with a preferred embodiment of the present invention.
Figure 2:
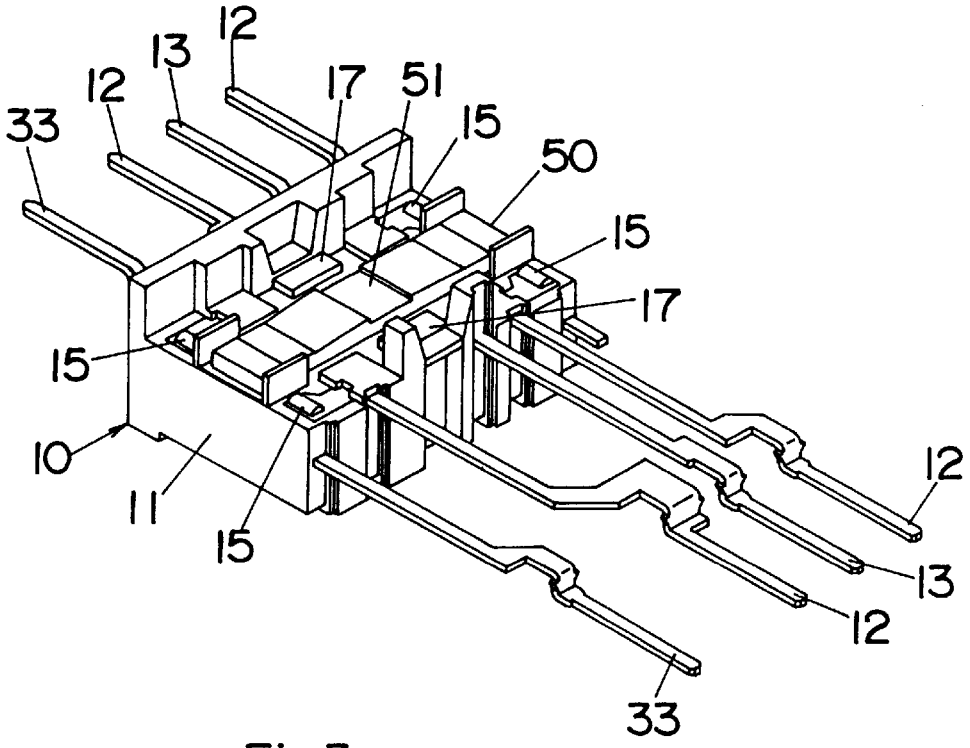
FIG. 2 is a perspective view of an electromagnet block.
Figure 3:
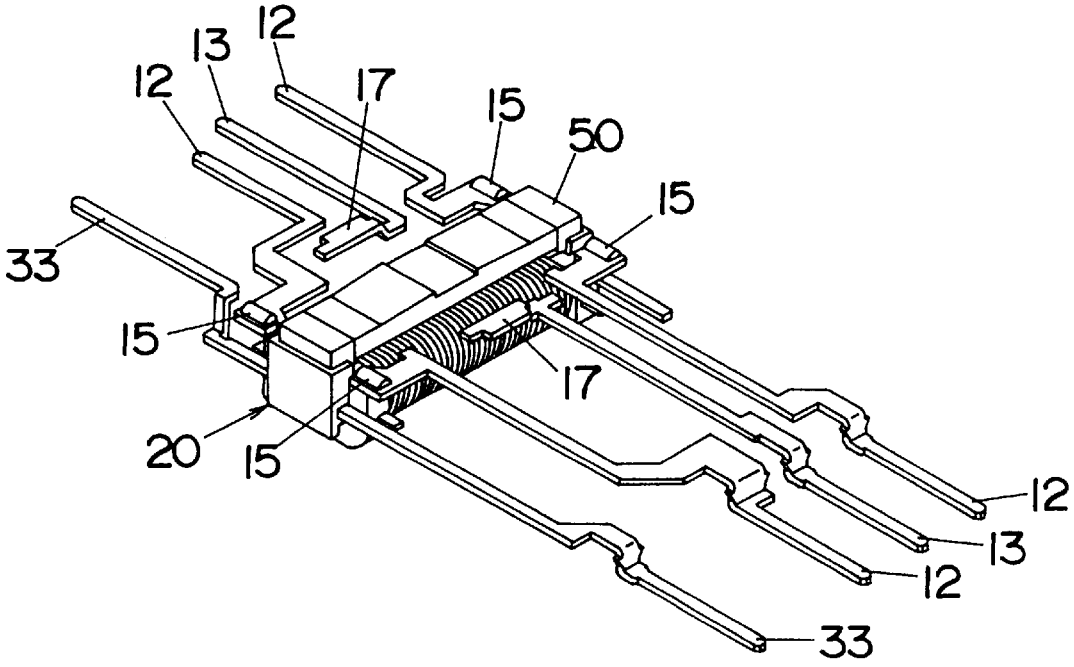
FIG. 3 is a perspective view of a coil assembly to be encapsulated into the electromagnet block of FIG. 2.
Figure 4:
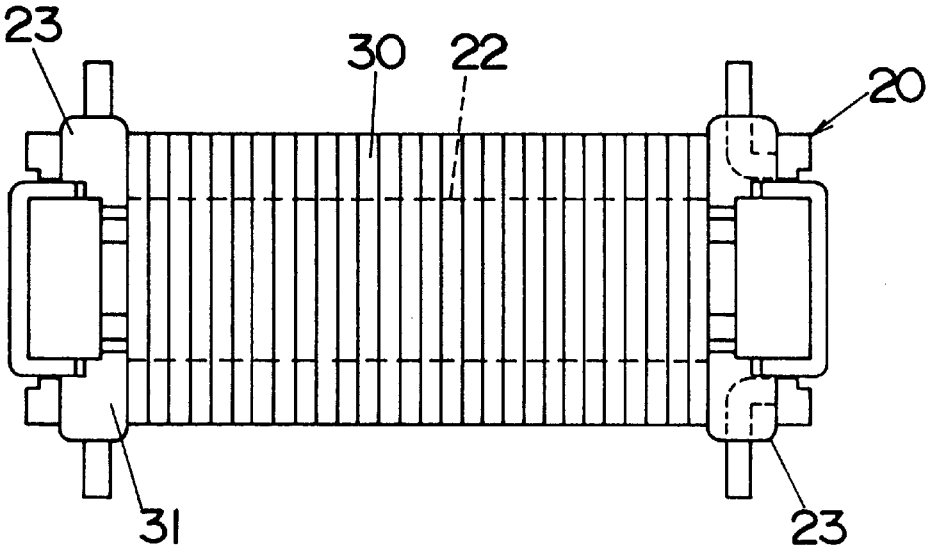
FIG. 4 is a top view of the coil assembly.

Referring now to FIGS. 1 to 3, there is shown an electromagnetic relay in accordance with a preferred embodiment of the present invention. The relay is composed of an electromagnet block 10, a contact block 60, and a cover 70. The electromagnet block 10 includes a base 11 of dielectric material holding a coil assembly 20 composed of a core 21 of magnetic material which carries an excitation coil 30, and a permanent magnet 50. The coil assembly 20 is encapuslated by a molding material into the base 11 of the electromagnet block 10 with six contact terminals 12, 13 and two coil terminals 33 for double-pole double-throw (DPDT) relay arrangement. Two pairs of fixed contacts 15 at the ends of the corresponding contact terminals 12 are supported on a base 11 on either side of the coil assembly 20. The remaining contact terminals are common contact terminals each defining at one end a land 17, which are held on the base 11 on either side thereof for electrical interconnection with each one of hinge tags 62 carried on the contact block 60. The coil terminals 33 are connected to the opposite ends of the coil 30 and extend from one end of the contact assembly 20 in opposite directions.

As shown in FIG. 1, the coil block 60 includes a rectangular armature 61 carrying on either side thereof a movable spring 62 in the form of a leaf spring defining the movable contacts 65 at opposite ends thereof. The movable spring 62 is formed at its center with a hinge tag 67 as an integral member for electrical as well as mechanical connection with the land 17 on the base 11 of the electromagnet block 10. The hinge tag 67 includes a flexible hinge portion which enables the contact block 60 as a whole to pivot about an axis for closing and opening the movable contacts 65 with respect to the fixed contacts 15 on the electromagnet block 10. The movable springs 62 are held on the armature 61 by means of a harness 68 made of a dielectric plastic material molded over the center of the armature and the corresponding portions of the movable springs 62. The harness 68 is formed on the bottom of the contact block with a fulcrum (not shown) which rests on a bottom of a groove 51 in the center of the permanent magnet 50. The electromagnet block 10 combined with the contact block 60 is enclosed by the cover 70. The contact terminals 12 and 13 as well as the coil terminal 33 shown in the right hand end of FIG. 2 are bent along the wall of the base 11 to extend in the same direction as the remaining terminals.

Figure 5:
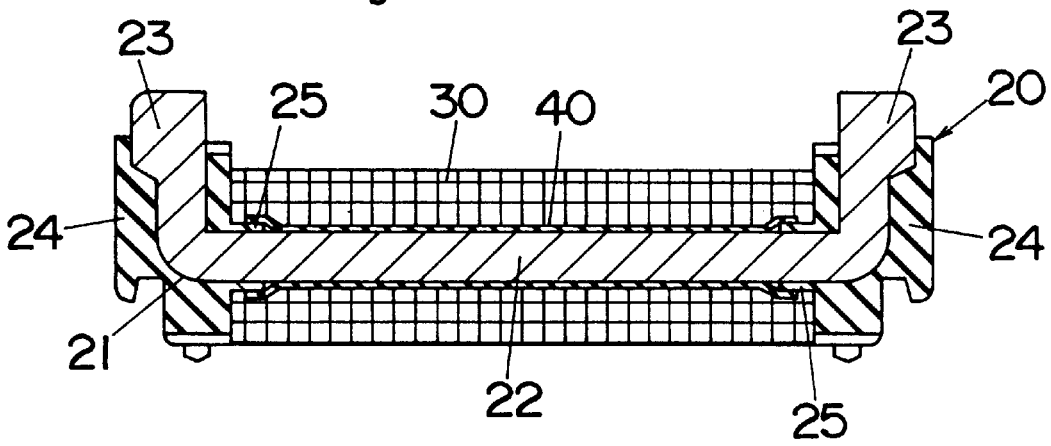
FIG. 5 is a longitudinal section of the coil assembly.

As shown in FIG. 5, the core 21 of the coil assembly 20 is shaped from a magnetic material into a generally U-shaped configuration with a center core 22 and a pair of yokes 23 upstanding from the opposite ends of the core 22. Molded around the yokes 23 are flanges 24 of a dielectric material which define a coil space therebetween around the center core 22. A thin-wall inward sleeve 25 is formed to extend integrally from each of the flanges 24 by a short distance to entirely surround the opposite ends of the center core 22. A tape 40 is wrapped around the center core with opposite width ends of the tape overlapping the inward sleeves 25, respectively so as to completely conceal the center core 22 therebehind. The tape 40 is made of a dielectric material, for example, polyester, polyimide and polyphenylenesulphide (PPS). The coil 30 is then wound around the tape 40 along the entire length between the flanges 24 and is therefore electrically insulated completely from the core 21. The ends 31 of the coil 30 are wired respectively to the ends of the coil terminals 33 molded into the one flange 24. The coil assembly thus formed is encapsulated by the molding material together with the permanent magnet 50 into the base 11 of the electromagnet block 10. The permanent magnet 50 is in the form of a three-pole magnet which is magnetized to have end poles of the same polarity, i.e., S pole and a center pole, i.e., N pole. The permanent magnet 50 extends between the upper ends of the yokes 23 and is cooperative with the armature 61 to form a magnetic circuit for the polarized relay operation as explained in detail in U.S. Pat. No. 5,337,029. In short, upon energization of the coil 30 by a current of selective direction, the armature 61 is caused to pivot so as to make one of the two movable contacts 65 on either side of the contact block 60 into engagement with the corresponding fixed contact 15, while disengaging the other movable contact 65 from the corresponding fixed contact 15. Upon deenergization of the coil 30, the armature 61 is held in this position. When the coil 30 is energized by the current of opposite direction, the armature 30 is then caused to pivot in the opposite direction to break the one contact and make the other contact. The relay operation may be a bistable in which the both of the two movable contacts 65 on either side of the contact block 60 is held stable upon deenergization of the coil 30, or monostable in which only one of the two movable contacts 65 is held stable upon deenergization of the coil 30.

Figure 6:
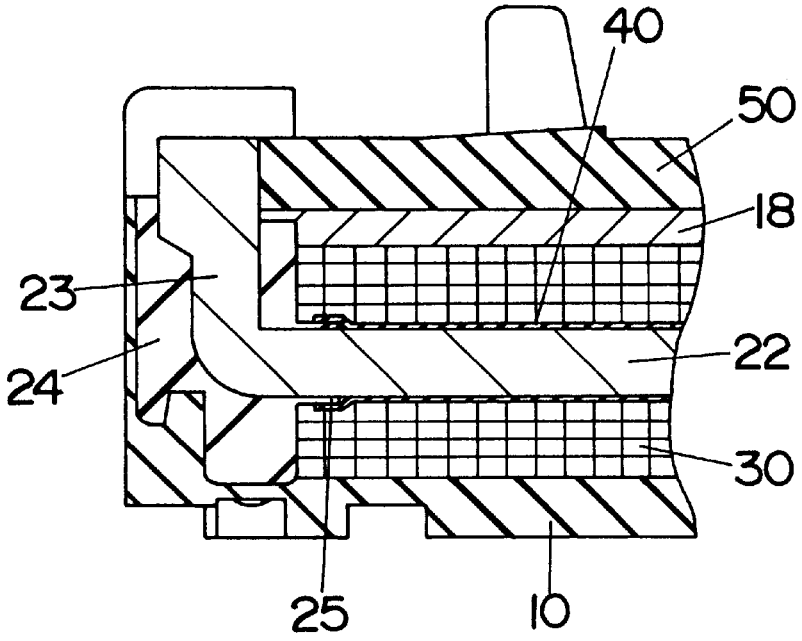
FIG. 6 is a partial sectional view of the electromagnet block encapsulated by a molding material.

The flange 24 of the coil assembly 20 is made of a first molding material which is different from a second molding material forming the base 11 of the electromagnet block 10. The difference is such that the first molding material has a melting point less than that of the second molding material. Therefore, when encapsulating the coil assembly 20 by the second molding material into the electromagnet block 10, the flange 24 of the first material is partially melted in its outer surface to merge into the base 11 of the first material being molded, bonding the flanges 24 tightly to the corresponding portions of the base 11 without leaving any substantial gap therebetween. Whereby, the coil assembly 20 is electrically isolated successfully from the contact terminals 12. In addition, the second material will proceed into a space between the permanent magnet 50 and the coil 30 to give an insulation layer 18, as shown in FIG. 6, which also merges into the flange 24 for successfully insulating the coil 30 from the yoke 23. The first molding material may be polybutylene-telephtalate (PBT) having a melting point of 220° C. and polycyclohexylenedimethylene terephthalete (PCT) having a melting point of 290° C., when a liquid crystal polyester having a melting point of 330° C. is selected as the second molding material. Further, the first and second molding material may be both liquid crystal polyesters but of different melting points. For example, the liquid crystal polyester of the first material is a semi-aromatic liquid crystal in which one of poly-alcohol and poly-basic acid is formed by aromatic group and the other is formed by aliphatic group, while the liquid crystal of the second material is a whole-aromatic liquid crystal having a higher melting point in which both of the poly-alcohol acid and poly-basic acid are formed by aromatic groups. When using the liquid crystal polyesters both for the first and second materials respectively forming the flange 24 and the base 11, it is possible to minimize heat stress developed at the interface between the flange 24 and the base 11 during a use in differing environmental conditions, thereby keeping tight adhesion between these members for reliable relay operation.

It should be noted in this connection that the encapsulation of the coil assembly 20 by the second material having a higher melting point than that of the first material forming the flanges 24 is found advantageous even independently of the feature of providing the inward sleeves 25, and is therefore equally applicable to other electromagnet blocks in which a coil assembly with flanges 24 made of a first molding material is encapsulated by a second molding material.

Figure 7:
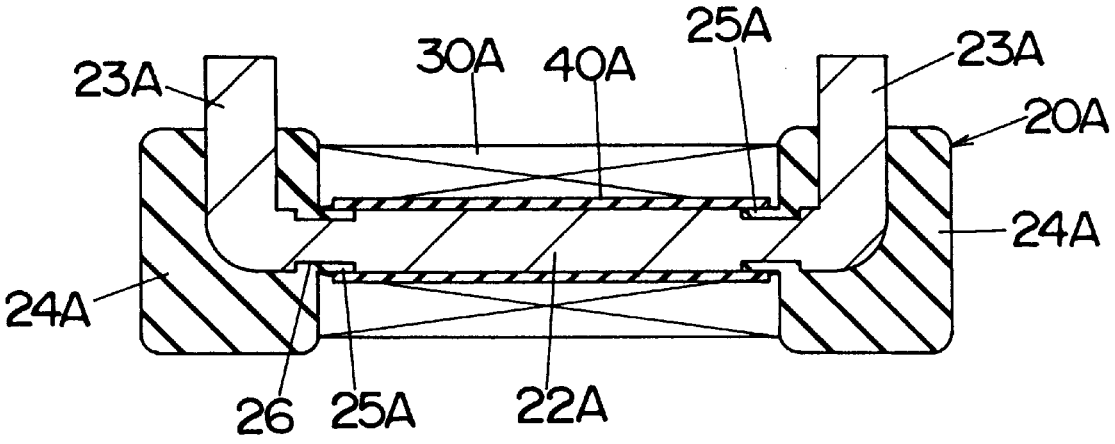
FIG. 7 is a longitudinal section of a modified coil assembly which may be utilized in the above relay.

FIG. 7 shows a modified coil assembly which is equally utilized in the relay of the present invention. The coil assembly 20A has a center core 22A which is shaped to have recesses 26 in the opposite ends thereof for receiving the inward sleeves 25A of the flanges 24A, respectively. The recess 26 extends the entire circumference of the center core in a such a depth that the inward sleeve 25A fitted in the recess 26 gives an outer surface continuous with the outer surface of the remaining major portion of center core 22A. Thus, the tape 40A can be wound smoothly over the sleeve 25A and the center core 22A. With this result, the coil 30A can be packed at an increased density between the flanges by an extent corresponding to the sections of the sleeve in relation to the above embodiment of FIGS. 5 and 6.

What is claimed is:

1. An electromagnetic relay comprising:

a pair of movable and fixed contacts;

an armature carrying the movable contact; and an electromagnet block having an excitation coil which moves said armature for closing and opening said contacts upon being energized, said electromagnet block including a core composed of a center core and a pair of yokes extending from opposite ends of said center core, flanges of dielectric material molded respectively around portions of said yokes, and a dielectric tape fitted around the center core over a length of said center core to receive therearound said excitation coil in an electrically insulating relation from said core, wherein each of said flanges is formed integrally with an inward sleeve which extends over a limited length along said center core in such a relation that said dielectric tape overlaps said the inward sleeves at opposite ends of said tape.

2. The electromagnetic relay as set forth in claim 1, wherein said center core is formed at each of its opposite ends respectively with a recess into which a corresponding inward sleeve is fitted to thereby provide a continuous outer surface from said inward sleeves to said center core.

3. The electromagnetic relay as set forth in claim 1, wherein said excitation coil is encapsulated together with said core and said flanges into the single electromagnet block by an encapsulating molding material which has a melting point higher than that of said flanges.

4. The electromagnetic relay as set forth in claim 3, wherein said encapsulation molding material is a liquid crystal polyester, while the molding material of said flanges is one of polybutylene-telephtalate (PBT) and polycyclohexylenedimethylene terrphthalate (PCT).

5. The electromagnetic relay as set forth in claim 3, wherein said encapsulation molding material is a first liquid crystal polyester, said dielectric material of said flanges is a second liquid crystal polyester and a melting point of said first liquid crystal polyester is higher than a melting point of said second liquid crystal polyester.

6. An electromagnetic relay comprising:

a pair of movable and fixed contacts;

an armature carrying the movable contact; and an electromagnet block having an excitation coil which moves said armature for closing and opening said contacts upon being energized;

said electromagnet block including a core receiving therearound said excitation coil in an electrically insulating relation from said core, and flanges of dielectric material molded respectively around opposite ends of said core, wherein said excitation coil is encapsulated together with said core and said flanges into the electromagnet block by an encapsulating molding material which has a melting point higher than that of said flanges.

7. The electromagnetic relay as set forth in claim 6, wherein said encapsulation molding material is a liquid crystal polyester, while the molding material of said flanges is one of polybutylene-telephtalate (PBT) and polycyclohexylenedimethylene terephthalate (PCT).

8. The electromagnetic relay as set forth in claim 6, wherein said encapsulation molding material is a first liquid crystal polyester, while said dielectric material of said flanges is a second liquid crystal polyester of and a melting point of said first liquid crystal polyester is higher than a melting point of said second liquid crystal polyester.

* * * * *